United States Patent [19]

Deaton

[11] Patent Number: 4,708,163

[45] Date of Patent: Nov. 24, 1987

[54] SAFETY VALVE

[75] Inventor: Thomas M. Deaton, Dallas, Tex.

[73] Assignee: Otis Engineering Corporation, Dallas, Tex.

[21] Appl. No.: 7,749

[22] Filed: Jan. 28, 1987

[51] Int. Cl.[4] ..... E21B 33/00

[52] U.S. Cl. ..... 137/460; 137/463; 166/319; 251/68

[58] Field of Search ..... 137/460, 463, 498; 166/319, 323; 251/68

[56] References Cited

U.S. PATENT DOCUMENTS

| | | | |
|---|---|---|---|
| 2,806,484 | 9/1957 | Schultz | 137/463 X |
| 3,032,111 | 5/1962 | Corley, Jr. et al. | 166/65 |
| 3,070,119 | 12/1962 | Raulins | 137/460 |
| 3,126,908 | 3/1964 | Dickens | 137/460 |
| 3,208,531 | 9/1965 | Tamplen | 166/125 |
| 3,273,588 | 9/1966 | Dollison | 137/460 |
| 3,665,955 | 5/1972 | Conner, Sr. | 137/495 |
| 3,902,523 | 9/1975 | Gaut | 137/498 |
| 4,161,215 | 7/1979 | Bourne, Jr. et al. | 166/65 |
| 4,339,001 | 7/1982 | Paschal, Jr. | 166/322 |
| 4,617,960 | 10/1986 | More | 137/554 |

*Primary Examiner*—Robert G. Nilson
*Attorney, Agent, or Firm*—Thomas R. Felger

[57] ABSTRACT

A subsurface safety valve. During normal well flowing conditions, the valve is spring biased to its open position. If the difference in fluid pressure flowing through the valve as compared to fluid pressure exterior to the valve exceeds a preselected value, a pressure sensitive bellows will be actuated to close the valve. A latch mechanism is provided to prevent undesired closure of the safety valve by acceptable pressure transients resulting from normal changes in well operating conditions. An alternative embodiment of the valve responds to an electromagnetic signal from the well surface.

28 Claims, 7 Drawing Figures

SAFETY VALVE

BACKGROUND OF THE INVENTION

1. Field of the Invention

The present invention discloses a subsurface safety valve which can be either pressure differential operated (direct acting) or closed in response to an electromagnetic signal.

2. Description of Related Art

Direct acting subsurface safety valves, which are closed by an increase in the fluid flow rate through the valve, are shown in U.S. Pat. Nos. 3,070,119 invented by George M. Raulins and 3,126,908 invented by George C. Dickens. Both of these patents disclose using a ball type detent mechanism to hold the respective valve closure means open until the flow rate through the respective valve exceeds a preselected value. U.S. Pat. Nos. 3,070,119 and 3,126,908 are incorporated by reference for all purposes within this application.

A direct acting subsurface safety valve, which is closed by a preselected rate of pressure differential change, is shown in U.S. Pat. No. 4,339,001 invented by James H. Paschal, Jr. This patent discloses a ball type detent mechanism to hold the valve open until the rate of change of fluid pressure within the valve exceeds the preselected value. U.S. Pat. No. 4,339,001 is incorporated by reference for all purposes within this application. Another direct acting safety valve is disclosed in U.S. patent application Ser. No. 06/824,779 filed Jan. 31, 1986 now U.S. Pat. No. 4,664,195.

Various types of direct acting subsurface safety valves are commercially available under the trademark STORM CHOKE®, registration number 695,910, assigned to Otis Engineering Corporation.

One problem with the use of direct acting safety valves is the ability of the valve to distinguish between fluctuations in fluid flow during normal production of the well and a transient flow condition caused by an emergency at the well surface. This problem is particularly difficult with respect to high flow rate gas wells. One advantage to direct acting safety valves is that they can be installed at deep depths in a well. At such depths, the pressure changes due to normal flow through the safety valve may be close to the pressure changes during emergency flow conditions. An important feature of the present invention is the ability to precisely adjust a direct acting safety valve to distingusih between a small pressure difference which is acceptable and a small pressure difference which indicates an emergency condition. For example, with a flowing bottom hole pressure of 2012 psig, a normal flow pressure difference through the safety valve might be 30 psig, while a difference of 35 psig would indicate an emergency condition. The normal flow rate for such wells might be 15 million to 75 million cubic feet of gas per day.

U.S. Pat. No. 4,161,215 discloses a solenoid operated safety valve which can be opened and closed in response to an electrical signal from the well surface. U.S. Pat. No. 4,617,960 discloses a system for closing a subsurface safety valve in response to an electromagnetic signal from the well surface. Both of these patents are incorporated by reference for all purposes within this application.

SUMMARY OF THE INVENTION

The present invention discloses a safety valve for installation within a well flow conductor comprising a housing means with a longitudinal flow passageway extending therethrough, a valve closure means having a first position allowing fluid flow through the longitudinal flow passageway and a second position blocking fluid flow through the longitudinal flow passageway, means for latching the valve closure means in its first position, bellows means attached to the valve closure means and partially defining a variable volume fluid chamber within the housing means, means for communicating fluid pressure between the interior of the variable volume chamber and the longitudinal flow passageway, means for equalizing fluid pressure between the exterior of the bellows means and the exterior of the housing means, the bellows means releasing the latching means and shifting the valve closure means from its first position to its second position.

The present invention includes a latching mechanism which can be adjusted to respond to a preselected small difference in pressure. This same latching mechanism can be adapted to respond to a small electromagnetic signal. A downhole safety valve of the present invention can be reliably closed without requiring a large amount of force, either mechanical or electrical, to actuate the valve.

One object of the present invention is to provide a new and improved differential pressure operated safety valve which is releasably held open by a latching means until the differential pressure change exceeds a predetermined value. The pressure difference is sensed between fluid pressure within a variable volume chamber within the valve and fluid pressure exterior to the valve. The valve can be selected to respond to very small changes in differential pressure.

Another object is to provide a differential pressure operated safety valve having a first pressure zone and a second pressure zone with means for equalizing pressure in the second pressure zone with fluid pressure exterior to the safety valve.

A further object of the present invention is to provide a safety valve which closes upon the occurrence of a change in differential pressure and will open when the difference in pressure is equalized.

A still further object is to provide a latching means and releasing means for a safety valve which will respond to small differential pressure changes in the pressure of fluids flowing through the valve. Response to small pressure changes is desired for safety valves installed at deep depths in high volume gas wells.

Additional objects and advantages of the present invention will be readily apparent to those skilled in the art from reading the following written description in conjunction with the drawings and claims.

DESCRIPTION OF THE PREFERRED EMBODIMENT

Figure 1:
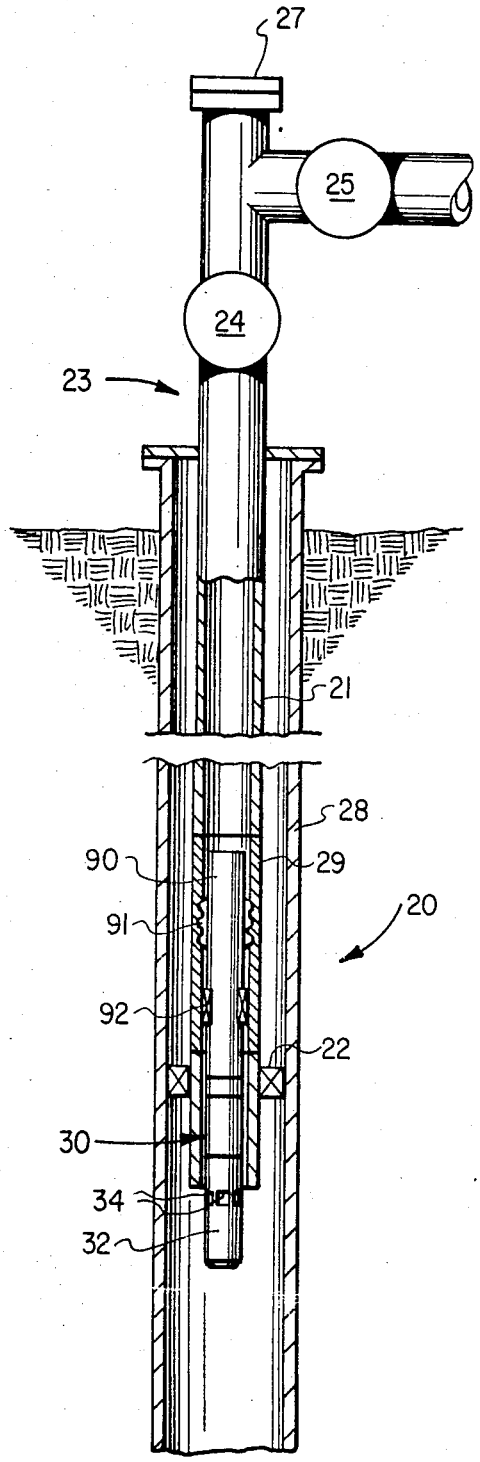
FIG. 1 is a schematic view partially in section showing a direct acting subsurface safety valve system embodying the present invention.
Figure 2:
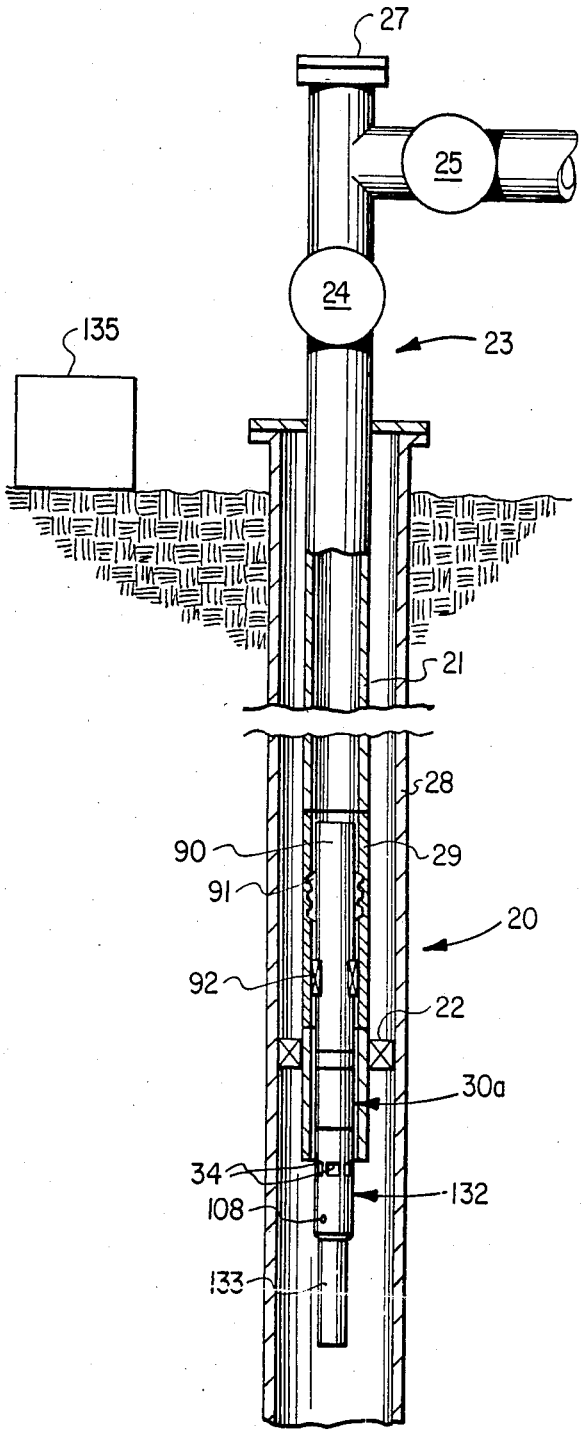
FIG. 2 is a schematic view partially in section showing the subsurface safety valve of FIG. 1 modified to respond to an electromagnetic signal.

In FIGS. 1 and 2 the same or similar components are given the same number. Well completion 20 includes casing string 28 extending from the well surface to a hydrocarbon producing formation (not shown). Tubing string 21 is concentrically disposed within casing 28 and extends from wellhead 23 through production packer 22 which seals between tubing string 21 and casing 28. Packer 22 directs formation fluids such as oil, gas, water, and the like into tubing string 21 from perforations (not shown) in casing 28 which admit formation fluids into the well bore. Flow control valves 24 and 25 at the well surface control fluid flow from tubing string 21. Wellhead cap 27 is provided on wellhead 23 to permit servicing of well 20 via tubing string 21 by wireline techniques which include the installation and removal of various downhole flow control devices such as safety valve 30. Other well servicing operations which may be carried out through tubing string 21, after the removal of safety valve 30, are bottom hole temperature and pressure surveys.

Figure 6:
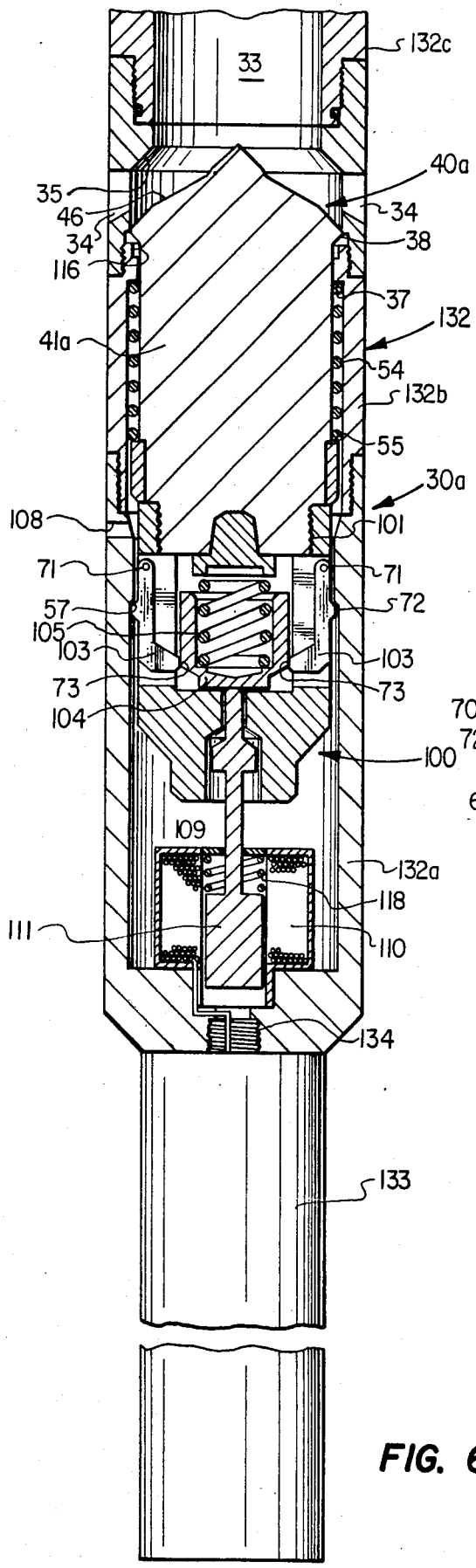
FIG. 6 is an enlarged view, partially in section and partially in elevation with portions broken away, showing the subsurface safety valve of the present invention modified to respond to an electromagnetic signal.
Figure 5:
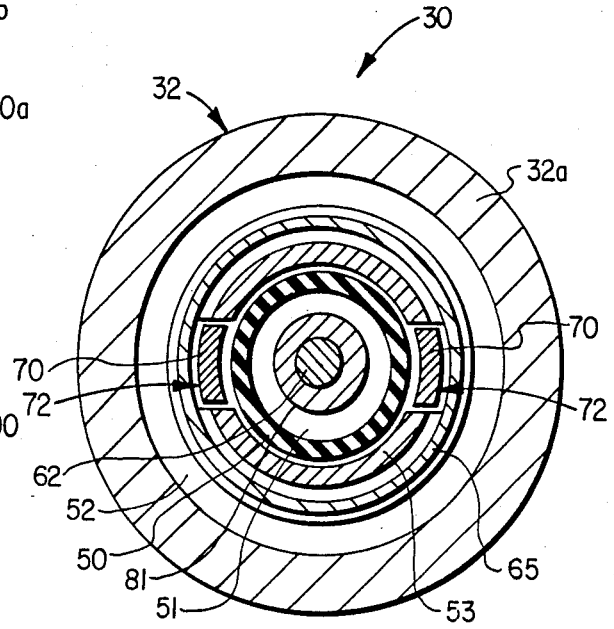
FIG. 5 is an enlarged view in section along line 5—5 of FIG. 3 showing the latching means.
Figure 7:
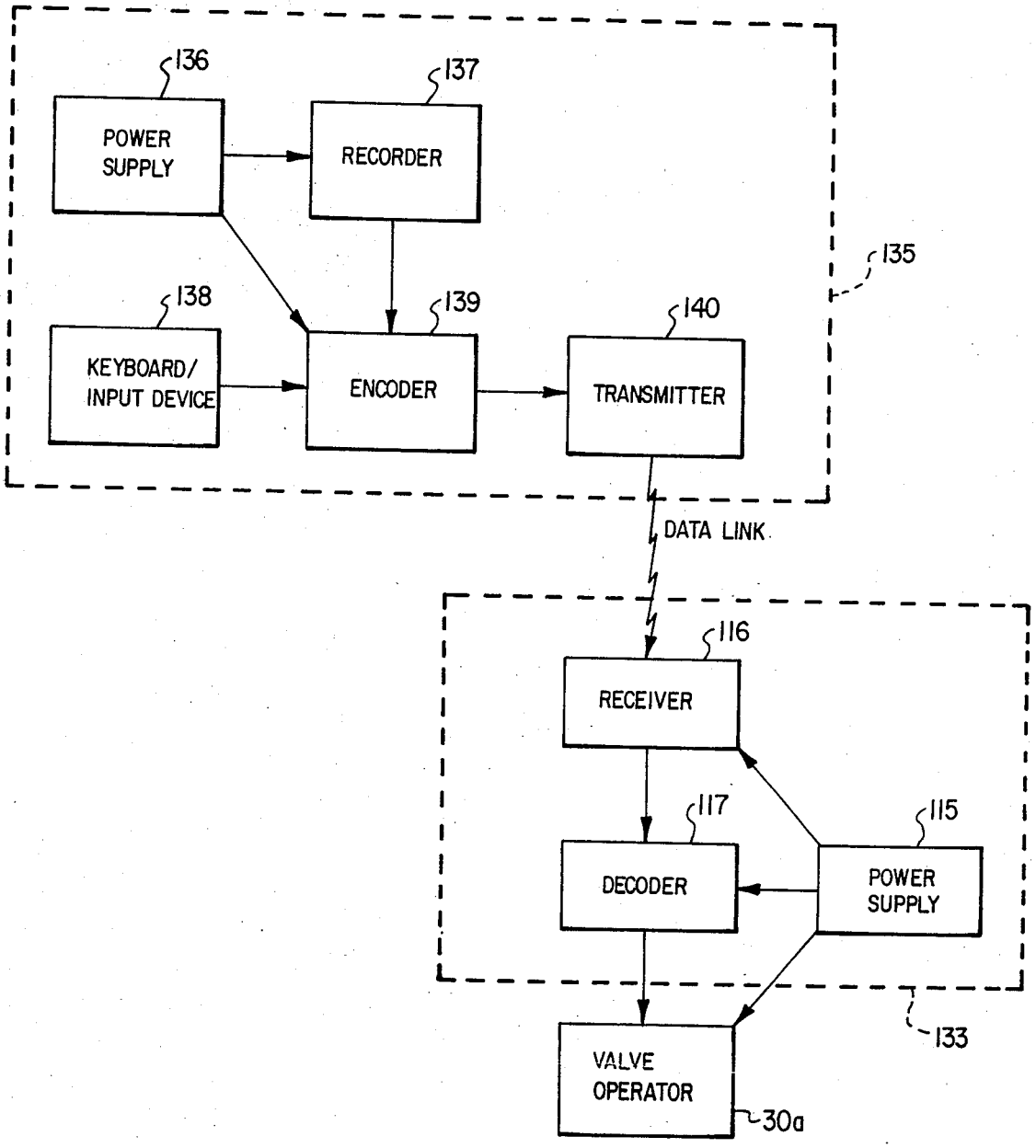
FIG. 7 is a block diagram of the control system for the safety valve shown in FIG. 6.

Either subsurface safety valve 30 or 30*a* may be installed in tubing string 21 to control fluid flow from a downhole location to the well surface via tubing string 21. Safety valve 30 refers to the mechanically actuated valve of FIGS. 1, 3, 4 and 5. Safety valve 30*a* refers to the electromagnetically actuated valve of FIGS. 2, 6 and 7. Landing nipple 29 is included as a part of tubing string 21 to provide a downhole location for installing either valve 30 or 30*a*. Lock mandrel 90 has keys 91 to releasably engage a matching profile in the interior of landing nipple 29. Lock mandrel 90 also has seal means 92 on its exterior to form a fluid barrier with the portion of landing nipple 29 adjacent thereto. Seal means 92 directs fluid flow within tubing string 21 through lock mandrel 90 and safety valve 30 attached thereto. U.S. Pat. No. 3,208,531 to Jack W. Tamplen discloses a landing nipple and lock mandrel satisfactory for use with the present invention.

Figure 3:
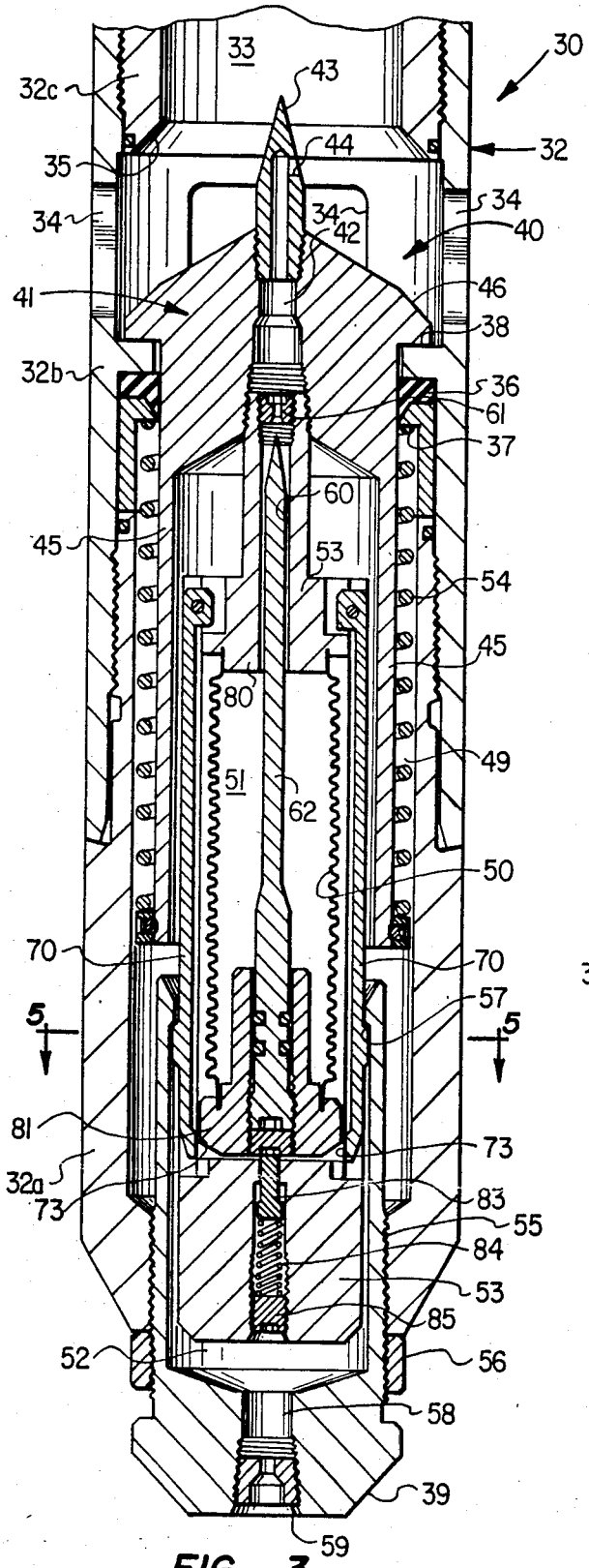
FIG. 3 is a drawing, partially in section and partially in elevation, showing the safety valve of FIG. 1 in its first, open position.
Figure 4:
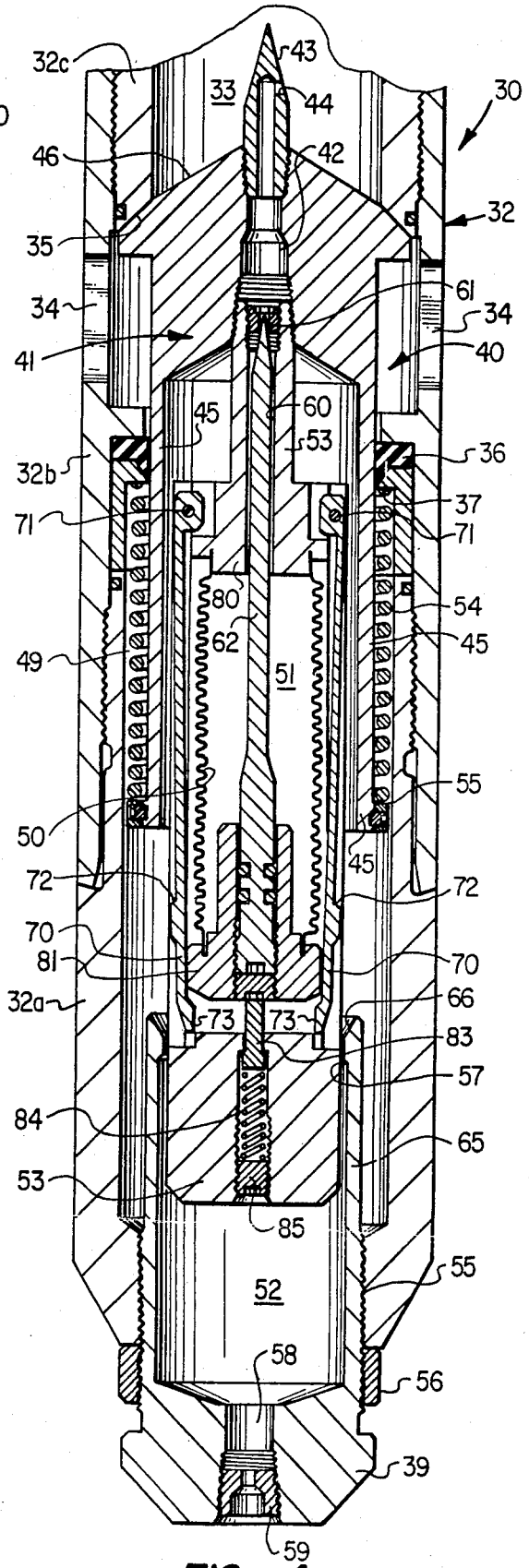
FIG. 4 is a drawing, partially in section and partially in elevation, showing the safety valve of FIG. 1 in its second, closed position.

Safety valve 30 includes poppet type valve closure means 40 which moves longitudinally between its first, open position (FIG. 3) and its second, closed position (FIG. 4). Valve closure means 40 responds to fluid pressure changes. As shown in U.S. Pat. No. 3,273,588 to W. W. Dollison, subsurface safety valves may use either a ball or flapper type valve closure means in addition to the poppet type. U.S. Pat. No. 3,273,588 is incorporated by reference for all purposes within this application.

The exterior of safety valve 30 is defined by housing means 32 with longitudinal flow passageway 33 extending therethrough. For ease of manufacture and assembly, housing means 32 has at least three subassemblies 32*ab*, and *c*. Each housing means subassembly is generally cylindrical with a longitudinal bore extending therethrough. Each subassembly is threadedly engaged to adjoining subassemblies with appropriate o-ring seals to prevent undesired fluid communication between the interior and exterior of housing means 32. The longitudinal bores of each housing subassembly are concentrically aligned to partially define longitudinal flow passageway 33. Valve seat 35 is formed on the extreme end of subassembly 32*c* disposed within subassembly 32*b*.

Housing subassembly 32*c* functions as a connector to any suitable lock assembly such as lock mandrel 90 for anchoring safety valve 30 within a well flow conductor. Preferably, the lock assembly will form a fluid barrier with the well flow conductor so that well fluid flow through the conductor can take place only via safety valve 30.

A plurality of openings 34 extend radially through housing means subassembly 32*b* to communicate fluid flow with longitudinal flow passageway 33. Valve closure means 40 is slidably disposed within housing means subassemblies 32*a* and 32*b* to control fluid flow via passageway 33. Valve closure means 40 has several components including poppet element 41. When valve closure means 40 is in its first position, poppet element 41 is spaced longitudinally away from valve seat 35. When valve closure means 40 is in its second position, poppet element 41 is firmly engaged with valve seat 35 to block undesired fluid flow through longitudinal flow passageway 33.

Poppet element 41 is a relatively long hollow cylinder with one end 46 closed except for bore 42 extending longitudinally therethrough. End 46 is sized to form a fluid tight seal with valve seat 35.

The other components of valve closure means 40 are attached to or carried by poppet element 41. Such components include bellows means 50, bellows carrier 53, and spring 54. Poppet element 41 is further defined by skirt 45 extending downwardly from end 46. Hollow nose 43 is attached by threads to bore 42 and projects into longitudinal flow passageway 33. First port means 44 communicates fluid pressure between passageway 33 and the interior of nose 43.

Bellows carrier 53 is attached by threads to bore 42 and is disposed within skirt 45. When valve closure means 40 is assembled, poppet element 41 and bellows carrier 53 move in unison as a single unit. Bellows means 50 can flex longitudinally relative to poppet element 41. The amount of flexing is restricted to prevent damage to bellows means 50 from high differential pressures.

Biasing means or spring 54 is carried on the exterior of skirt 45. Annulus 49 is formed between the exterior of skirt 45 and the interior of housing means 32 adjacent thereto. Spring 54 is disposed between shoulder 37 on the interior of housing subassembly 32*b* and shoulder 55 near the extreme lower end of skirt 45 opposite end 46. Spring 54 biases valve closure means 40 to its first position. The length of travel of valve closure means 40 is defined by end 46 resting on shoulder 38 (first position FIG. 3) and end 46 contacting annular seat 35 (second position FIG. 4).

Housing means subassembly 32*b* carries annular seal 36 on its interior to form a fluid barrier with the exterior of poppet element 41 adjacent thereto. Seal 36 is sized to allow poppet element 41 to slide longitudinally therethrough. Various components of valve closure means 40 including bellows means 50 cooperate with annular seal 36 to divide the interior of housing means 32 into a first pressure zone 51 and a second pressure zone 52. An important feature of the present invention is the ability of valve closure means 40 to reliably and repeatedly respond to small changes in differential pressure between zone 51 and zone 52.

Plug 39 is engaged by threads 55 with the extreme lower end of housing means subassembly 32*a*. Lock ring 56 can be used to adjust the threaded engagement between plug 39 and subassembly 32*a*. Plug 39 has skirt 65 extending longitudinally therefrom to position flange 57 within housing means 32. Flange 57 provides a portion of the means for latching valve closure means 40 in its first position. Plug 39 also has second port 58 extending therethrough to provide means for equalizing fluid pressure between the exterior of housing means 32 and second pressure zone 52. Regulating orifice 59 can be screwed into port 58 to control the fluid flow rate via port 58. Regulating orifice 59 is one of several adjustments which can be made to control the sensitivity of valve 30 to fluid pressure changes within longitudinal flow passageway 33.

The primary task of bellows means 50 is to release valve closure means 40 from its first position in response to a preselected difference in pressure between pressure zone 51 and zone 52. Bellows means 50 has several components to carry out this task including bellows carrier 53 and latch fingers 70. Bellows means 50 is flexibly disposed between first end cap 80 and second end cap 81. The upper portion of bellows carrier 53 functions as first end cap 80. Second end cap 81 can move relative to bellows carrier 53 and latch fingers 70 as bellows means 50 expands and contracts with changes in differential pressure. Second end cap 81 functions similar to slidable ring 104 which will be described later.

At least one and preferably two or more latch fingers 70 are disposed on bellows carrier 53. One end of each latch finger 70 is attached by pivot pin 71 to bellows carrier 53. Pivot pin 71 allows limited rotational movement of the attached latch finger 70. Shoulder 72 projects from each finger 70 towards housing means 32. Flange 57 on plug 39 is sized for engagement with shoulders 72. Flange 57 and shoulders 72 are located such that second end cap 81 of bellows means 50 will hold valve closure means 40 in its first position when shoulder 72 is secured within flange 57. Thus fingers 70, pivot pin 71, second end cap 81, shoulders 72, and flange 57 comprise a portion of the means for latching valve closure means 40 in its first position. By latching bellows carrier 53 to housing means 32 via plug 39, high fluid flow rates through longitudinal flow passageway 33 are prevented from shifting valve closure means 40 to its second position. Therefore, safety valve 30 can be satisfactorily used in gas wells having very high flow rates.

Flange 57 has an inwardly tapered surface 66 which is formed to contact shoulders 72 of latch fingers 70. Downward movement of valve closure means 40 and attached bellows means 50 causes slight rotation of fingers 70 around pivot pins 71. Flange 57 is designed to hold latch fingers 70 engaged with housing means 32. When bellows means 50 is in its fully extended position (FIG. 3), second end cap 81 is positioned adjacent to lower end 73 of latch fingers 70 to prevent latch fingers 70 from rotating inwardly. Shoulders 72 are machined with a slight taper such that when a difference in pressure contracts bellows means 50, second end cap 81 will move upwardly to allow fingers 70 to pivot inwardly away from annular flange 57 and release valve closure means 40.

Fluid pressure in longitudinal flow passageway 33 is communicated with pressure zone 51 (interior of bellows means 50) via first port means 44, bore 42, and passageway 60 of first end cap 80. Thus, first port means 44 and the flow path defined by bore 42 and passageway 60 provide means for communicating fluid pressure between the variable volume chamber means and fluid pressure flowing through longitudinal flow passageway 33. Small valve seat 61 is threadedly engaged with passageway 60 to control fluid flow therethrough. Valve stem or rod 62 is disposed with bellows means 50 to form a fluid barrier with valve seat 61. Valve stem 62 and valve seat 61 function as a needle valve to control fluid flow from bellows means 50. When valve stem 62 engages valve seat 61, fluid pressure is trapped within bellows means 50 to prevent any further collapse thereof. Valve stem 62 is a sturdy, structural member attached to second end cap 81 to prevent damage to bellows means 50 when subjected to an excessive differential pressure between zone 51 and zone 52.

Plunger 83 projects from bellows carrier 53 and abuts second end cap 81. Spring 84 is disposed within bellows carrier 53 and applies force to plunger 83. Adjusting nut 85 is threadedly engaged with bellows carrier 53 to allow varying the compression of spring 84. By compressing spring 84, more force is placed on plunger 83 which in turn tends to compress bellows means 50. Thus, spring 84 via plunger 83 cooperates with the difference in pressure between zone 51 and zone 52 to activate bellows means 50 and release valve closure means 40.

Operating Sequence

The following comments are made assuming that safety valve 30 is installed in a gas producing well completed as shown in FIG. 1. Safety valve 30 is opened by admitting fluid pressure from the well surface via flow control valves 24 and 25 into tubing string 21 to equalize any pressure difference across valve closure means 40. This same fluid pressure is communicated via port means 44 and the flow path defined by bore 42 and passageway 60 to first pressure zone 51. When fluid pressures in zones 51 and 52 are equal, force from biasing means 54 will move poppet element 41 longitudinally relative to housing means 32 to open valve closure means 40. Bellows carrier 53 moves in unison with poppet element 41. As tapered surface 66 of flange 57 contacts latch fingers 70, latch fingers 70 will rotate slightly inward to engage shoulders 72 with flange 57 to latch valve closure means 40 in its first position. Safety valve 30 is thus opened as shown in FIG. 3 to allow fluid flow to the well surface via longitudinal flow passageway 33 and tubing 21. Normal flowing conditions result in a small difference in fluid pressure between longitudinal flow passageway 33 (first pressure zone 51) and the exterior of housing means 32 (second pressure zone 52).

Some variation in fluid pressure and fluid flow rate through longitudinal flow passageway 33 is expected during normal well conditions especially for gas wells. Changes in pressure within longitudinal flow passageway 33 are communicated with first pressure zone 51 via port means 44. During an emergency condition such as damage to wellhead 23 which allows fluids to escape from tubing string 21, the resulting increase in fluid flow rate through longitudinal flow passageway 33 will cause a corresponding decrease in fluid pressure below normally expected limits. As previously noted, second pressure zone 52 is subject to fluid pressure from the exterior of housing means 32. Therefore, an unusual drop in pressure within longitudinal flow passageway 33 results in a change to the net differential pressure force acting to compress bellows means 50. A preselected amount of pressure force can move bellows means 50 longitudinally away from flange 57. This movement will release latch fingers 70 from housing means 32. The net forces acting on bellows means 50 can next overcome spring 54 and move poppet element 41 and bellows carrier 53 upwardly, forcing end 46 into contact with valve seat 35. Thus, first port means 44, the flow path through bellows carrier 53, second port means 58, and annular seal 36 provide a portion of the means for shifting valve closure means 40 from its first position to its second position after latch fingers 70 have been released.

Plunger 83, spring 84, and adjusting nut 85 comprise a portion of the means for adjusting the difference in pressure which activates bellows means 50. As previously noted, increased compression of spring 84 applies a force via plunger 83 and second end cap 81 to assist differential pressure to compress bellows means 50. The sensitivity of safety valve 30 can also be adjusted by installing other valve seats 61 with different sized openings therethrough. Valve seat 61 functions as an orifice to control the rate of pressure change within bellows means 50. Installing a valve seat 61 with a larger opening in passageway 60 results in bellows means 50 responding to smaller changes in pressure within longitudinal flow passageway 33. If valve seat 61 has a smaller opening, a larger change in pressure within longitudinal flow passageway 33 is required to activate bellows means 50. In a similar manner, different sized regulating orifices 59 can be installed in second port means 58 to adjust the sensitivity of safety valve 30 to pressure changes between the exterior of housing means 32 and second pressure zone 52.

Alternative Embodiments

Safety valve 30 or 30*a* may be used in any suitable well flow conductor having an appropriate downhole location to receive the safety valve and to direct fluid flow therethrough. Other well completions may have multiple tubing strings or have only casing 28.

Safety valve 30*a* includes poppet type valve closure means 40*a* which moves longitudinally between its first, open position (FIG. 6) and its second, closed position (not shown). In FIG. 2 valve closure means 40*a* responds to an electromagnetic signal from the well surface. The exterior of safety valve 30*a* is defined by housing means 132 with longitudinal flow passageway 33 extending therethrough. For ease of manufacture and assembly, housing means 132 has at least three subassemblies 132*a*, *b*, and *c*. Each housing means subassembly is generally cylindrical with a longitudinal bore extending therethrough. Each subassembly is threadedly engaged to adjoining subassemblies in the same manner as described for safety valve 30. Valve seat 35 is formed on the extreme end of subassembly 132*c* disposed within subassembly 132*b*. Housing subassembly 132*c* performs the same functions as previously described for housing subassembly 32*c*.

A plurality of openings 34 extend radially through housing means subassembly 132*b* to communicate fluid flow with longitudinal flow passageway 33. Valve closure means 40*a* is slidably disposed within housing means subassemblies 132*a* and 132*b* to control fluid flow via passageway 33. Valve closure means 40*a* has several components including poppet element 41*a*. When valve closure means 40*a* is in its first position, poppet element 41*a* is spaced longitudinally away from valve seat 35. When valve closure mean 40*a* is in its second position, poppet element 41*a* is firmly engaged with valve seat 35 to block undesired fluid flow through longitudinal flow passageway 33.

Poppet element 41*a* is a relatively long cylinder with one end 46 sized to form a fluid tight seal with annular valve seat 35. Latch means 100 is engaged by threads 101 to the other end of poppet element 41*a*. Biasing means or spring 54 is carried on the exterior of poppet element 41*a* disposed between shoulder 37 on the interior of housing subassembly 132*b* and shoulder 55 near latch means 100. Spring 54 biases valve closure means 40*a* to its first position. The length of travel of valve closure means 40*a* is defined by end 46 resting on shoulder 38 (first position FIG. 6) and end 46 contacting annular seat 35 (second position not shown).

Latch means 100 has a plurality of latch fingers 103 which are carried by valve closure means 40*a*. Latch fingers 103 and 70 are similar in design and function. Each latch finger 103 has a shoulder 72 sized to engage flange 57 on the interior of housing means 132*a*. Shoulders 72 and flange 57 cooperate to provide a portion of the means for releasably engaging latch fingers 103 with housing means 132. Slidable ring 104 fits adjacent to end 73 of fingers 103 to prevent fingers 103 from pivoting inwardly when valve closure means 40*a* is in its first position. Spring 105 is disposed within latch means 100 to provide means for biasing slidable ring 104 to its first position which projects latch fingers 103 radially outward. Slidable ring 104 and spring 105 function in a manner similar to bellows means 50 and second end cap 81 to release latch fingers 103 and 70 respectively. Slidable ring 104 and second end cap 81 are designations which could be used interchangeably to describe the corresponding structure in safety valves 30 and 30*a*.

By applying force to slidable ring 104, spring 105 will be compressed while moving slidable ring 104 to its second position (not shown) which allows latch fingers 103 to retract inwardly. The means for applying this force and releasing latch fingers 103 to allow valve closure means 40*a* to shift to its second position includes electrical solenoid 110 and plunger 111 slidably disposed therein.

Housing means 132 has electrical package 133 attached thereto by threads 134. The exterior of electrical package 133 is a metallic cylinder suitable for use in a downhole environment to protect electrical power supply 115 and electrical circuits such as receiver 116 and decoder 117 contained therein. Receiver 116 is tuned to accept electromagnetic signals from surface unit 135. When the appropriate signal is sent from receiver 116 to decoder 117, solenoid 110 will be energized by power supply 115 to move plunger 111 to its second position. This movement of plunger 111 will compress spring 105 and release latch fingers 103.

End 46 of poppet element 41*a* is subject to fluid pressure within longitudinal flow passageway 33. One or more ports 108 extend radially through housing means 132 to equalize fluid pressure between the interior and exterior of housing means 132. This portion of housing means 132 is designated as pressure zone 109. Ports 108 are spaced longitudinally below openings 34 so that valve closure means 40*a* is subjected to the difference between fluid pressure flowing through longitudinal flow passageway 33 and fluid pressure in pressure zone 109 of housing means 132. Contact between end 46 and shoulder 38 when valve closure means 40a is in its first position, prevents equalization of pressure between longitudinal flow passageway 33 and pressure zone 109. For some well completions, it may be necessary to install an elastomeric seal in annular groove 116 to form a fluid barrier with the exterior of poppet element 41a adjacent thereto. Port 108 and pressure zone 109 provide a portion of the means for applying the difference between fluid pressure flowing in the longitudinal flow passageway 33 and fluid pressure exterior to housing means 132 to valve closure means 40a. The pressure difference can thus shift valve closure means 40a to its second position after latch fingers 103 have been released by plunger 111.

Spring 118 is included within solenoid 110 to bias plunger 111 to its first position which allows latch fingers 103 to hold valve closure means 40a in its first position.

Surface unit 135 includes various electronic circuits such as power supply 136, recorder 137, keyboard or input device 138, encoder 139, and transmitter 140. U.S. Pat. Nos. 4,617,960; 3,032,111; and 3,665,955 disclose various electrical circuits and components which are satisfactory for use with safety valve 30a. By selecting properly sized springs 105 and 118, latch means 100 can be reliably actuated in response to an electromagnetic signal and will require only a small amount of electrical energy from downhole power supply 115. Thus, safety valve 30a can remain downhole for considerable periods of time without having to be retrieved to replace power supply 115.

Valve closure means 41a will remain in its closed position even though solenoid 110 is de-energized as long as a difference in pressure exists between longitudinal flow passageway 33 and pressure zone 109. This characteristic of safety valve 30a adds to the downhole life of power supply 115. When fluid pressure within longitudinal flow passageway 33 is equalized with fluid pressure exterior to housing means 132, spring 54 will return valve closure means 40a to its first position, spring 105 will return slidable ring 104 to its first position, and spring 118 will return plunger 111 to its first position. Safety valve 30a is thus latched open until latch means 100 is actuated by an electromagnetic signal from the well surface.

The preceding written description explains only some embodiments of the present invention. Those skilled in the art will readily see other modifications and variations without departing from the scope of the invention which is defined by the claims.

What is claimed is:

1. A safety valve for installation within a well flow conductor comprising:

a. a housing means with a longitudinal flow passageway extending therethrough;

b. a valve closure means having a first position allowing fluid flow through the longitudinal flow passageway and a second position blocking fluid flow through the longitudinal flow passageway;

c. means for biasing the valve closure means to its first position;

d. bellows means partially defining a variable volume chamber means within the housing means;

e. means for communicating fluid pressure between the variable volume chamber means and fluid pressure flowing through the longitudinal flow passageway;

f. means for latching the valve closure means in its first position;

g. the bellows means including means for releasing the latching means; and h. means for shifting the valve closure means from its first position to its second position after the latching means has been released.

2. A safety valve as defined in claim 1 wherein the latching means further comprises:

a. a latch finger carried on the exterior of the bellows means;

b. means for releasably engaging the latch finger with the housing means; and c. a portion of the bellows means holding the latch finger engaged with the housing means.

3. A safety valve as defined in claim 2 wherein the means for releasably engaging the latch finger comprises an annular flange on the interior of the housing means and a shoulder on the finger sized to contact the flange.

4. A safety valve as defined in claim 2 wherein the means for releasing the latching means further comprises:

a. the bellows means flexibly disposed between a first end cap and a second end cap;

b. the bellows means dividing the variable volume chamber means into a first pressure zone and a second pressure zone; and c. means for equalizing fluid pressure between the exterior of the housing means and the second pressure zone.

5. A safety valve as defined in claim 4 wherein a preselected difference in pressure between the first pressure zone and the second pressure zone activates the bellows means to release the latching means.

6. A safety valve as defined in claim 5 further comprising:

a. an annulus formed between the exterior of valve closure means and the interior of the housing means;

b. the annulus comprising a portion of the variable volume chamber means;

c. the communicating means comprising a first port means and flow path extending from the interior of the bellows means through the valve closure means to allow fluid communication with the longitudinal flow passageway; and d. the equalizing means comprising a second port means extending through the housing means.

7. A safety valve as defined in claim 6 further comprising:

a. a rod concentrically disposed within the bellows means with one end securely attached to the second end cap; and b. the other end of the rod sized to engage the first end cap after a preselected amount of compression of the bellows means whereby the rod and the end caps cooperate to prevent excessive differential pressure from damaging the bellows means.

8. A safety valve as defined in claim 6 wherein the difference in pressure between the first pressure zone and the second pressure zone functions as a portion of the means for shifting the valve closure means from its first position to its second position.

9. A safety valve as defined in claim 6 wherein the bellows means further comprises:

a. a bellows carrier attached to and partially disposed within the poppet element;
b. a portion of the bellows carrier functioning as the first end cap; and
c. at least two or more latch fingers pivotally attached to the bellows carrier.

10. A safety valve for installation within a well flow conductor comprising:
a. a housing means;
b. a longitudinal flow passageway extending through the housing means;
c. a valve closure means having a first position allowing fluid flow through the longitudinal flow passageway and a second position blocking fluid flow through the longitudinal flow passageway;
d. the valve closure means having a poppet element slidably disposed within the housing means;
e. means for biasing the poppet element to shift the valve closure means to its first position;
f. an annular seal formed between the exterior of the poppet element and the interior of the housing means;
g. bellows means disposed within the poppet element and flexibly attached thereto;
h. valve seat means carried by the housing means and engagable with the poppet element;
i. variable volume chamber means formed within the housing means and partially defined by the bellows means and the annular seal which divide the chamber means into a first pressure zone and a second pressure zone;
j. means for latching the valve closure means in its first position;
k. means for communicating fluid pressure between the longitudinal flow passageway and the first pressure zone; and
1. means for equalizing fluid pressure between the exterior of the housing means and the second pressure zone.

11. A safety valve as defined in claim 10 wherein:
a. the communicating means further comprises first port means and a flow path extending through the poppet element to communicate fluid pressure with the interior of the bellows means; and
b. the equalizing means further comprises a second port means extending through the housing means whereby the bellows means may respond to differences in pressure between the first zone and the second zone.

12. A safety valve as defined in claim 11 wherein the latching means further comprises:
a. a latch finger carried on the exterior of the bellows means;
b. means for releasably engaging the latch finger with the housing means; and
c. a portion of the bellows means holding the latch finger engaged with the housing means.

13. A safety valve as defined in claim 12 wherein the means for releasably engaging the latch finger comprises an annular flange on the interior of the housing means and a shoulder on the finger sized to contact the flange.

14. A safety valve as defined in claim 12 further comprising means for adjusting the difference in pressure which activates the bellows means.

15. A safety valve as defined in claim 14 wherein the adjusting means further comprises a first orifice installed within the first port means and flow path to regulate pressure changes therethrough.

16. A safety valve as defined in claim 14 wherein the adjusting means further comprises a second orifice installed within the second port means to regulate pressure changes therethrough.

17. A safety valve as defined in claim 14 wherein the bellows means further comprises:
a. a bellows carrier attached to and partially disposed within the poppet element;
b. a portion of the bellows carrier functioning as the first end cap; and
c. at least two or more latch fingers pivotally attached to the bellows carrier.

18. A safety valve as defined in claim 17 wherein the adjusting means further comprises:
a. a plunger disposed in the bellows carrier;
b. a second spring to force one end of the plunger to abut the second end cap; and
c. an adjusting nut to vary the tension in the second spring whereby spring tension via the plunger cooperate with the pressure difference which activates the bellows means.

19. A safety valve as defined in claim 18 further comprising:
a. a rod concentrically disposed within the bellows means with one end securely attached to the second end cap; and
b. the other end of the rod sized to engage the first end cap after a preselected amount of compression of the bellows means whereby the rod and the end caps cooperate to prevent excessive differential pressure from damaging the bellows means.

20. A safety valve for installation within a well flow conductor comprising:
a. a housing means with a longitudinal flow passageway extending therethrough;
b. a valve closure means having a first position allowing fluid flow through the longitudinal flow passageway and a second position blocking fluid flow through the longitudinal flow passageway;
c. means for biasing the valve closure means to its first position;
d. a plurality of latch fingers carried by the valve closure means;
e. means for releasably engaging the latch fingers with the housing means whereby the latch fingers hold the valve closure means in its first position;
f. means for releasing the latch fingers to allow the valve closure means to shift to its second position;
g. means for applying the difference between the pressure of fluid flowing within the longitudinal flow passageway and fluid exterior to the housing means to the valve closure means whereby the difference in pressure can shift the valve closure means to its second position;
h. the valve closure means having a poppet element slidably disposed within the housing means; and
i. the releasable engaging means comprising a slidable ring, having a first position which projects the latch fingers radially outward and a second position which allows the latch fingers to retract inwardly, and means for biasing the slidable ring to its first position.

21. A safety valve as defined in claim 20 wherein the means for releasably engaging the latch finger further comprises an annular flange on the interior of the housing means and a shoulder on each finger sized to contact the flange.

22. A safety valve as defined in claim 20 wherein the means for releasing the latch fingers further comprises:

a. an electrical solenoid with a plunger slidably disposed therein;

b. the plunger having a first position which allows the latch fingers to hold the valve closure means in its first position and a second position which releases the latch fingers;

c. an electrical power supply to energize the solenoid; and d. an electrical circuit to connect the power supply to the solenoid in response to electromagnetic signals from the well surface.

23. A safety valve as defined in claim 22 further comprising means for biasing the plunger to its first position.

24. A safety valve as defined in claim 20 wherein the means for releasing the latch fingers further comprises:

a. bellows means acting as the means for biasing the slidable ring to its first position;

b. the bellows means partially defining a variable volume chamber means within the housing means;

c. the bellows means dividing the variable volume chamber means into a first pressure zone and second pressure zone;

d. means for communicating fluid pressure between the first pressure zone and fluid pressure flowing through the longitudinal flow passageway; and e. means for equalizing fluid pressure between the exterior of the housing means and the second pressure zone.

25. A safety valve as defined in claim 24 further comprising:

a. a rod concentrically disposed within the bellows means with one end securely attached to the slidable ring; and b. the other end of the rod sized to engage a portion of the valve closure means after a preselected amount of compression of the bellows means whereby the rod and slidable ring cooperate to prevent excessive differential pressure from damaging the bellows means.

26. A safety valve as defined in claim 25 further comprising:

a. a bellows carrier attached to and partially disposed within the poppet element;

b. the bellows means flexibly disposed between a first end cap and a second end cap; and c. a portion of the bellows carrier functioning as the first end cap.

27. A safety valve as defined in claim 26 further comprising means for adjusting the difference in pressure which activates the bellows means.

28. A safety valve as defined in claim 27 wherein the adjusting means further comprises:

a. a plunger disposed in the bellows carrier;

b. a second spring to force one end of the plunger to abut the second end cap; and c. an adjusting nut to vary the compression of the second spring whereby spring force via the plunger cooperate with the pressure difference which activates the bellows means.

* * * * *